US006407538B1

(12) United States Patent
Kinoshita et al.

(10) Patent No.: US 6,407,538 B1
(45) Date of Patent: Jun. 18, 2002

(54) VOLTAGE DOWN CONVERTER ALLOWING SUPPLY OF STABLE INTERNAL POWER SUPPLY VOLTAGE

(75) Inventors: Mitsuya Kinoshita; Fukashi Morishita, both of Hyogo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/793,594

(22) Filed: Feb. 27, 2001

(30) Foreign Application Priority Data

Jun. 22, 2000 (JP) ..... 12-188150

(51) Int. Cl.[7] ..... G05F 3/16

(52) U.S. Cl. ..... 323/314; 323/316; 327/541; 365/226

(58) Field of Search ..... 323/312–316; 327/540, 541; 365/226

(56) References Cited

U.S. PATENT DOCUMENTS 5,856,756 A * 1/1999 Sasahara et al. ..... 327/540
5,973,484 A * 10/1999 Cho ..... 323/269
6,064,188 A * 5/2000 Takashima et al. ..... 323/316
6,184,744 B1 * 2/2001 Morishita ..... 327/541
6,297,624 B1 * 10/2001 Mitsui et al. ..... 323/316

FOREIGN PATENT DOCUMENTS

| | | |
|---|---|---|
| JP | 62-260355 | 11/1987 |
| JP | 6-266452 | 9/1994 |
| JP | 10-27027 | 1/1998 |

* cited by examiner

*Primary Examiner*—Peter S. Wong
*Assistant Examiner*—Gary L. Laxton
(74) *Attorney, Agent, or Firm*—McDermott, Will & Emery

(57) ABSTRACT

A voltage down converter includes a first voltage down converting circuit and a second voltage down converting circuit. The first voltage down converting circuit supplies an internal power supply voltage VCCS1 to an internal circuit only during a period T when the internal power supply voltage VCCS1 falls below a predetermined voltage according to a signal DCE. In the first voltage down converting circuit, P channel MOS transistors are selectively activated according to the levels of the plurality of voltages, and a voltage down converting partial circuit supplies a current of an amount corresponding to the level of the external power supply voltage VCC to a power supply node. As a result, even during the period T, the internal power supply voltage can be maintained at a level of the reference voltage.

8 Claims, 10 Drawing Sheets

VOLTAGE DOWN CONVERTER ALLOWING SUPPLY OF STABLE INTERNAL POWER SUPPLY VOLTAGE

BACKGROUND OF THE INVENTION

1. Field of the Invention

The present invention relates to voltage down converters used in semiconductor memory devices.

2. Description of the Background Art

To accommodate increased storage capacity in the semiconductor memory devices, a great effort has been made to achieve higher densification and higher integration. One technique that realizes the higher densification and higher integration is a miniaturization of component elements.

The advancement in miniaturization of component elements has an adverse effect of decrease in breakdown voltage of insulated gate field effect transistors (hereinafter referred to as MOS transistors), which are component elements. Therefore, when a power supply voltage received from an external source as an operating power supply voltage is directly supplied to an MOS transistor, the power supply voltage exceeds the breakdown voltage of the MOS transistor, and a sufficient reliability cannot be secured with regard to factors such as breakdown voltage of insulated films.

Hence, in dynamic semiconductor memory devices hereinafter referred to as DRAM) with the storage capacity equal to or exceeding 16 Mbit, for example, an external power supply voltage is lowered to the level of an internal power supply voltage and each component element is operated with the internal power supply voltage to secure a sufficient reliability of each component element.

FIG. 7 is a schematic block diagram showing an overall structure of an DRAM 140 as an example of a conventional semiconductor memory device. In FIG. 7, DRAM 140 includes an internal circuit 90, a voltage down converter 91 and a circuit 92 operated with an external power supply voltage.

Voltage down converter 91 lowers the level of an external power supply voltage VCC supplied to a VCC power supply node to generate an internal power supply voltage VCCS on a VSS power supply node.

Internal circuit 90 operates using internal power supply voltage VCCS on a VCCS power supply node as an operating power supply. Such internal circuit 90 includes a memory cell array having a plurality of MOS transistors as component elements, a sense amplifier performing a sense amplification of data read out from the memory cell array and so on.

Circuit 92 operated with an external power supply voltage operates with external power supply voltage VCC on VCC power supply node as an operating power supply. Such circuit 92 operated with external power supply voltage includes a circuit performing data input/output.

Here, internal circuit 90, voltage down converter 91 and circuit 92 operated with an external power supply voltage receive a power supply voltage VSS (hereinafter referred to as a ground voltage) of a different level from external power supply voltage VCC at the VSS power supply node.

Therefore, in the memory cell or the sense amplifier, that is, internal circuit 90, MOS transistors, which are their component elements, receive internal power supply voltage VCCS generated by lowering external power supply voltage VCC as an operating power supply voltage.

Thus, even when the higher densification and higher integration of the memory cell array is achieved and the breakdown voltage of the MOS transistor, which is a component element, decreases as a result of miniaturization, a voltage applied to a gate insulated film thereof can be suppressed to a low level. Therefore, the reliability of the component elements can be secured and a stable and reliable operation of DRAM 140 as a whole can be obtained.

FIG. 8 is a circuit diagram showing a structure of conventional voltage down converter 91 shown in FIG. 7. In FIG. 8, voltage down converter 91 includes an operational amplifier 70 and a P channel MOS transistor 77.

Operational amplifier 70 receives an internal power supply voltage VCCS, which is to be an output of voltage down converter 91, at its positive, input and receives a reference voltage VREF from a reference voltage generation circuit not shown at its negative input. Operational amplifier 70 performs an operational amplification on reference voltage VREF and an internal power supply voltage VDD to output a control voltage VOUT at an output node 75.

Then, P channel MOS transistor 77, under the control of control voltage VOUT, supplies a current from the VCC power supply node to a power supply node 78 to adjust a voltage level of internal power supply voltage VCCS at power supply node 78.

Operational amplifier 70 forms a current mirror type operational amplifier including P channel MOS transistors 71 and 72, N channel MOS transistors 73 and 74 and constant-current source circuit 76 as shown in FIG. 8.

Here, P channel MOS transistor 71 and N channel MOS transistor 73, and P channel MOS transistor 72 and N channel MOS transistor 74 are connected in parallel with each other and both pairs are connected between VCC power supply node and one terminal of constant-current source circuit 76.

Further, N channel MOS transistor 73 receives reference voltage VREF at its gate, whereas N channel MOS transistor 74 receives internal power supply voltage VCCS on power supply node 78 at its gate.

Constant-current source circuit 76 has another terminal connected to the VSS power supply node. Constant-current source circuit 76 also controls the amount of current of operational amplifier 70 such that a sum of a current amount flowing from N channel MOS transistor 73 and a current amount flowing from N channel MOS transistor 74 is always at a constant level.

Control voltage VOUT of operational amplifier 70 is output from output node 75, which is a connection point of P channel MOS transistor 71 and N channel MOS transistor 73.

A connection node 79, that is a connection point of P channel MOS transistor 72 and N channel MOS transistor 74 is connected to respective gates of P channel MOS transistor 71 and P channel MOS transistor 72.

Operational amplifier 70 operates with external power supply voltage VCC and ground voltage VSS as operating power supply, and when a level of internal power supply voltage VCCS rises above a level of reference voltage VREF, operational amplifier 70 raises a voltage level of output node 75, that is control voltage VOUT, up to a level of external power supply voltage VCC at the highest.

As a result, the channel resistance of P channel MOS transistor 77 receiving control voltage VOUT at its gate increases to reduce the current supply from the VCC power supply node to power supply node 78 and to lower the voltage level of internal power supply voltage VCCS.

On the other hand, when internal power supply voltage VCCS falls below the level of reference voltage VREF, operational amplifier 70 lowers control voltage VOUT to the level of ground voltage VSS (=0 V) at the lowest.

As a result, P channel MOS transistor 77 becomes conductive and amount of current supplied from the VCC power supply node to power supply node 78 increases and the level of internal power supply voltage VCCS is raised.

Thus, voltage down converter 91 feeds back internal power supply voltage VCCS and compares internal power supply voltage VCCS with reference voltage VREF. Then, the result of comparison is amplified to generate control voltage VOUT, which is used for controlling P channel MOS transistor 77 used for driving the power supply. Thus, voltage down converter 91 operates to hold internal power supply voltage VCCS at a constant voltage level, that is the level of reference voltage.

In voltage down converter 91 shown in FIG. 8. however, in some cases the voltage level of internal power supply voltage VCCS stays at a level significantly lower than the level of reference voltage VREF, depending on an operation state of internal circuit 90 which uses internal power supply voltage VCCS output from voltage down converter 91 as an operating power supply, and the voltage level of internal power supply voltage VCCS cannot be secured at a target value, which is the voltage level of reference voltage VREF.

Assume that internal circuit 90 operates and consumes a current on power supply node 78. As described above, voltage down converter 91 shown in FIG. 8 is responsive to the change in the voltage level on power supply node 78 and, when internal power supply voltage VCCS falls below the level of reference voltage VREF, lowers control voltage VOUT to render P channel MOS transistor 77 used for driving the power supply conductive. FIG. 9 is a timing chart of control voltage VOUT and internal power supply voltage VCCS in conventional voltage down converter 91. The ordinate represents a voltage V and the abscissa represents a time.

The period from time t1 to time t2 represents an operating period of internal circuit 90. Here, assume that the amount of current consumption of internal circuit 90 from power supply node 78 is high. In this case, in response to the fall of internal power supply voltage VCCS from time t1, the voltage level of control voltage VOUT falls to increase the supply of current from P channel MOS transistor 77 to power supply node 78.

Operational amplifier 70 generates control voltage VOUT by comparing internal power supply voltage VCCS and reference voltage VREF and amplifying the result of comparison. Hence, a certain time is necessary for compensating the fall of internal power supply voltage VCCS and recovering internal power supply voltage VCCS to the level of reference voltage VREF. As a result, during the time period from time t1 to time t2, which is the operating period of internal circuit 90, internal power supply voltage VCCS becomes significantly lower than reference voltage VREF.

In addition, P channel MOS transistor 77 used for driving the power supply is driven based on control voltage VOUT which is controlled in an analog manner in the range between the level of ground voltage VSS and the level of external power supply voltage VCC. Therefore, to make a current flowing from the VCC power supply node to power supply node 78 variable according to the variation in potential of control voltage VOUT, P channel MOS transistor 77 must have a wider channel width.

One way to solve the problem of requirement of the P channel MOS transistor with wide channel width is to provide a voltage down converter 910 shown in FIG. 10. Voltage down converter 910 is formed by adding a buffer 82 and a P channel MOS transistor 83 to voltage down converter 91 and replacing P channel MOS transistor 77 with a P channel MOS transistor 84. Buffer 82 is constituted of two inverters connected in series. P channel MOS transistor 84 has a narrower channel width than that of P channel MOS transistor 77. Buffer 82 receives control voltage VOUT on node 75 as an input, converts control voltage VOUT, which is an analog signal, to a digital signal of an H (logical high) level or an L (logical low) level and supplies the resulting digital signal to the gate of P channel MOS transistor 83. Thus, P channel MOS transistor 83 is inactivated when an H level signal is supplied from buffer 82 and is activated when an L level signal is supplied from buffer 82. P channel MOS transistor 84 operates in the same manner as P channel MOS transistor 77 of voltage down converter 91 based on analog control voltage VOUT.

Thus, P channel MOS transistor 83 is activated/inactivated in a digital manner through control voltage VOUT, and P channel MOS transistor 84 is activated/inactivated in an analog manner through control voltage VOUT. As a current is supplied from the VCC power supply node to power supply node 78 via two P channel MOS transistors 83 and 84, the level of the voltage on power supply node 78 can be maintained at the level of internal power supply voltage VCCS through P channel MOS transistors 83 and 84 with a narrow channel width even when control voltage VOUT varies in an analog manner.

In voltage down converter 910, however, when external power supply voltage VCC varies, the driveability of P channel MOS transistor 84 per channel width varies. Here, the channel width of P channel MOS transistor 84 is constant regardless of the level of external power supply voltage VCC. Therefore, assume that the channel width of P channel MOS transistor 84 is determined such that internal power supply voltage VCCS is in the predetermined range even when the level of external power supply voltage VCC is at an upper limit of the standard. If the level of external power supply voltage VCC changes to a lower limit of the standard, the driveability of P channel MOS transistor 84 becomes insufficient to maintain the level of internal power supply voltage VCCS in the predetermined range.

In addition, similarly to voltage down converter 91, during the operating period of internal circuit 90, internal power supply voltage VCCS becomes significantly lower than the level of reference voltage VREF because voltage down converter 910 adapts a structure in which internal power supply voltage VCCS is compared with reference voltage VREF.

SUMMARY OF THE INVENTION

Therefore, an object of the present invention is to provide a voltage down converter capable of maintaining the internal power supply voltage at the level of the reference voltage even during a period when the internal circuit of the semiconductor memory device operates and falls the internal power supply voltage by a significant amount from the level of reference voltage.

A voltage down converter according to the present invention is provided with a first voltage down converting circuit to lower an external power supply voltage on a first input node to generate an internal power supply voltage at a first output node, and a second voltage down converting circuit to lower the external power supply voltage on a second input node to generate the internal power supply voltage at a second output node, for operating an internal circuit by the internal power supply voltage generated on the first output node or the second output node, wherein the first voltage down converting circuit includes; a first voltage down converting partial circuit to lower the external power supply voltage by passing an operating current from the first input node to the first output node to generate the internal power supply voltage on the first output node, and a digital driving circuit to drive the first voltage down converting partial circuit to maintain a voltage on the first output node at the internal power supply voltage by varying the operating current of the first voltage down converting partial circuit stepwise according to a level of the external power supply voltage or the internal power supply voltage only during a period when the internal power supply voltage falls below a predetermined voltage, and the second voltage down converting circuit includes a comparison circuit to perform an operational amplification on a result of comparison of the internal power supply voltage on the second output node and an internal reference voltage to output the result of amplification, and a second voltage down converting partial circuit to receive an output of the comparison circuit and to lower the external power supply voltage to generate the internal power supply voltage on the second output node.

In the voltage down converter according to the present invention, the first voltage down converting circuit passes an operating current from the first input node of the first voltage down converting partial circuit to the first output node without comparing the internal power supply voltage with the reference voltage, to lower the external power supply voltage to the level of the internal power supply voltage. The digital driving circuit sets the operating current of the first voltage down converting partial circuit at the reference current value when the external power supply voltage or the internal power supply voltage is at the level of the-reference voltage, and drives the first voltage down converting partial circuit such that the operating current of the first voltage down converting partial circuit is decreased stepwise from the reference current value when the external power supply voltage or the internal power supply voltage rises above the level of the reference voltage, and that the operating current of the first voltage down converting partial circuit is increased stepwise from the reference current value when the external power supply voltage or the internal power supply voltage falls below the level of the reference voltage. Then, the first voltage down converting partial circuit passes such operating current from the first input node to the first output node that the voltage on the first output node is maintained at the level of internal power supply voltage based on the drive from the digital driving circuit.

In addition, the second voltage down converting circuit lowers the external power supply voltage to the internal power supply voltage by comparing the internal power supply voltage with internal reference voltage. The comparison circuit compares the internal power supply voltage with the internal reference voltage and, when the internal power supply voltage is higher than the level of the internal reference voltage, the second voltage down converting partial circuit lowers the external power supply voltage by a large amount to lower the internal power supply voltage and when the internal power supply voltage is lower than the level of the internal reference voltage, the second voltage down converting partial circuit lowers the external power supply voltage by a small amount to raise the internal power supply voltage.

The first voltage down converting circuit and the second voltage down converting circuit are connected in parallel with the internal circuit of the semiconductor memory device. During the period when the internal power supply voltage falls below a level of a predetermined voltage, the internal power supply voltage is supplied to the internal circuit from the first voltage down converting circuit. Other than the period when the internal power supply voltage falls below the predetermined voltage level, the internal power supply voltage is supplied to the internal circuit from the second voltage down converting circuit. Thus, according to the present invention, the voltage down converter can always supply a stable internal power supply voltage even if the internal power supply voltage falls by a significant amount because of the sense amplification of the data read out from the memory cell. In addition, regardless of the variation in the external power supply voltage or the internal power supply voltage, voltage down converter can supply a stable internal power supply voltage to the internal circuit.

Preferably, the first voltage down converting partial circuit of the first voltage down converting circuit is constituted of MOS transistors with variable channel width and the digital driving circuit drives the first voltage down converting partial circuit to change the channel width of the MOS transistor stepwise according to the level of the external power supply voltage or the internal power supply voltage.

The digital driving circuit sets the channel width of the MOS transistor at such channel width that the operating current of the reference current value flows when the external power supply voltage or the internal power supply voltage is at the level of the reference voltage; sets the channel width of the MOS transistor at such channel width that the current generated by decreasing the current stepwise from the reference current value flows when the external power supply voltage or the internal power supply voltage rises above the level of the reference voltage; and sets the channel width of the MOS transistor at such channel width that the current generated by increasing the current amount stepwise from the reference current value flows when the external power supply voltage or the internal power supply voltage falls below the reference voltage. Then, the first voltage down converting partial circuit passes such operating current from the first input node to the first output node that the voltage on the first output node is maintained at the level of the internal power supply voltage based on the drive from the digital driving circuit. Hence, according to the present invention, regardless of the variation of the external power supply voltage or the internal power supply voltage, the voltage on the first output node can be maintained at the level of the internal power supply voltage through the change in the channel width of the MOS transistor.

Preferably, the first voltage down converting partial circuit in the first voltage down converting circuit is constituted of a plurality of MOS transistors having a same channel width and connected in parallel between the first input node and the first output node, and the digital driving circuit drives the first voltage down converting partial circuit to change stepwise the number of MOS transistors to be activated among the plurality of MOS transistors according to the level of the external power supply voltage.

The digital driving circuit sets the number of the MOS transistors to be activated at such number that the operating current of the reference current value flows when the external power supply voltage is at the level of the reference voltage; sets the number of the MOS transistors at such number that the current generated by decreasing the current amount stepwise from the reference current value flows when the external power supply voltage becomes higher than the reference voltage; and sets the number of the MOS transistors at such number that the current generated by increasing the reference current value stepwise flows when the external power supply voltage falls below the reference voltage. Thus, the first voltage down converting partial circuit passes such operating current that the voltage on the first output node is maintained at the level of the internal power supply voltage by changing the number of MOS transistors to be activated based on the drive from the digital driving circuit. Thus, according to the present invention, regardless of the variation in the external power supply voltage, the voltage on the first output node can be maintained at the level of the internal power supply voltage through the change in the number of the MOS transistors to be activated.

Preferably, the first voltage down converting partial circuit in the first voltage down converting circuit is constituted of a plurality of MOS transistors connected in parallel between the first input node and the first output node, and the digital driving circuit drives the first voltage down converting partial circuit to change stepwise the number of MOS transistors to be activated among the plurality of MOS transistors according to the level of the internal power supply voltage.

The digital driving circuit sets the number of the MOS transistor to be activated to the number such that the operating current of the reference current value flows when the internal power supply voltage is at the level of the reference voltage; sets the number of the MOS transistor to be activated to the number such that the current generated by decreasing the current stepwise from the reference current value flows when the internal power supply voltage rises above the level of the reference voltage; and sets the number of the MOS transistor to be activated such that the current generated by increasing the current amount stepwise from the reference current value flows when the internal power supply voltage falls below the reference voltage. Then, the first voltage down converting partial circuit passes such operating current from the first input node to the first output node that the voltage on the first output node is maintained at the level of the internal power supply voltage based on the drive from the digital driving circuit by changing the number of MOS transistors to be activated. Hence, according to the present invention, regardless of the variation of the internal power supply voltage, the voltage on the first output node can be maintained at the level of the internal power supply voltage through the change in the channel width of the MOS transistor.

Preferably, the digital driving circuit of the first voltage down converting circuit includes a voltage divider circuit to divide the external power supply voltage into a plurality of voltages corresponding to the plurality of MOS transistors, and a digital signal generation circuit to generate a digital activation signal based on the plurality of voltages only during a period when the internal power supply voltage falls below a predetermined voltage, and the voltage divider circuit divides the external power supply voltage to generate the digital activation signal to change stepwise the number of MOS transistors to be activated according to the level of the external power supply voltage.

The voltage divider circuit divides the external power supply voltage into a plurality of voltages according to the level thereof. When the external power supply voltage varies from the level of the reference voltage, the external power supply voltage is divided according to the resulting level from variation. When the external power supply voltage rises, the levels of the divided voltages rise, too, whereas if the external power supply voltage falls, the levels of the divided voltages fall, too.

Then, the digital signal generation circuit generates a digital activation signal for activating the MOS transistor of necessary numbers for the first voltage down converting partial circuit to pass the reference current value when the external power supply voltage is at the level of reference voltage. In addition, the digital signal generation circuit generates a digital activation signal for decreasing stepwise the number of MOS transistors to be activated when the external power supply voltage is higher than the level of the reference voltage. Further, the digital signal generation circuit generates a digital activation signal for increasing stepwise the number of the MOS transistors to be activated when the external power supply voltage is lower than the level of the reference voltage.

Then, in the first voltage down converting partial circuit, the MOS transistors of such numbers are driven that the voltage on the first output node is maintained at the level of the internal power supply voltage based on the digital activation signal from the digital driving circuit. Therefore, according to the present invention, the voltage on the first output node can be maintained at the level of the internal power supply voltage regardless of the variation in the external power supply voltage.

Preferably, the digital driving circuit in the first voltage down converting circuit includes a voltage divider circuit to divide the internal power supply voltage into a plurality of voltages corresponding to the plurality of MOS transistors, and a digital signal generation circuit to generate a digital activation signal based on the plurality of voltages only during a period when the internal power supply voltage falls below a predetermined voltage, and the voltage divider circuit divides the internal power supply voltage to generate the digital activation signal changing stepwise the number of MOS transistors to be activated according to the level of the internal power supply voltage.

The voltage divider circuit divides the internal power supply voltage into a plurality of voltages according to the level thereof. When the internal power supply voltage varies from the level of the reference voltage, the internal power supply voltage is divided according to the resulting level from variation. When the internal power supply voltage rises, the levels of the divided voltages rise, too, whereas if the internal power supply voltage falls, the levels of the divided voltages fall, too.

Then, the digital signal generation circuit generates a digital activation signal for activating the MOS transistor of necessary numbers for the first voltage down converting partial circuit to pass the reference current value when the internal power supply voltage is at the level of reference voltage. In addition, the digital signal generation circuit generates a digital activation signal for decreasing stepwise the number of MOS transistors to be activated when the internal power supply voltage is higher than the level of the reference voltage. Further, the digital signal generation circuit generates a digital activation signal for increasing stepwise the number of the MOS transistors to be activated when the internal power supply voltage is lower than the level of the reference voltage.

Then, in the first voltage down converting partial circuit, the MOS transistors of such numbers are driven that the voltage on the first output node is maintained at the level of the internal power supply voltage based on the digital activation signal from the digital driving circuit. Therefore, according to the present invention, the voltage on the first output node can be maintained at the level of the internal power supply voltage regardless of the variation in the external power supply voltage.

Preferably, the voltage divider circuit included in the digital driving circuit of the first voltage down converting circuit is constituted of a plurality of resistance elements connected in series between the first input node and the ground terminal, and the digital signal generation circuit includes a plurality of nodes provided respectively between plurality of resistance elements to generate the plurality of voltages, a plurality of inverters provided corresponding to the plurality of nodes to convert voltages on the plurality of nodes to an output signal of a first logic or a second logic according to a level of the voltage, and a plurality of logic elements provided corresponding to the plurality of inverters to generate the digital activation signal based on a signal attaining the first logic only during a period when the internal power supply voltage falls below a predetermined voltage and an output signal from each of the plurality of inverters, and each of the plurality of logic elements generates a signal to activate the MOS transistor when the output signal is in the first logic.

To the plurality of resistance elements forming the voltage divider circuit, a current is supplied from the external power supply voltage or the internal power supply voltage. Then, the plurality of resistance elements divide the external power supply voltage or the internal power supply voltage into the plurality of fractions of voltage.

The voltage divider circuit supplies the plurality of fractions of voltage into a plurality of inverters via a plurality of nodes and the plurality of inverters convert the inputs to a signal of an H level or an L level according to the level of the input voltage. When the input voltage is lower than a threshold value, the inverter outputs an H level signal and when the input voltage is higher than the threshold value, the inverter outputs an L level signal. Each of the plurality of logical elements receives an output signal of an inverter and a signal attaining an H level only during a period when the internal power supply voltage is lower than a predetermined voltage. Further, each of the plurality of logical elements performs an NAND operation of two signals when the MOS transistor forming the first voltage down converting partial circuit is a P channel MOS transistor and performs an AND operation of two signals when the MOS transistor forming the first voltage down converting partial circuit is an N channel MOS transistor. Thus, the plurality of fractions of voltage generated by the voltage divider circuit can be converted into digital signals reflecting the variation thereof. In addition, the digital activation signal activating the MOS transistor can be output only during a period when the internal power supply voltage falls below a predetermined voltage.

Preferably, the voltage divider circuit included in the first voltage down converting circuit is activated only during a period when the internal power supply voltage falls below a predetermined voltage and the voltage divide circuit further includes an MOS transistor provided between the plurality of resistance elements and the ground terminal.

When the internal power supply voltage is not lower than a predetermined voltage, the MOS transistor is inactivated and the current which flows from the first output node through the plurality of resistance elements in the voltage divider circuit is blocked at the MOS transistor. Hence, generation of a through current can be prevented in the voltage divider circuit when the first voltage down converting circuit is not driven.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
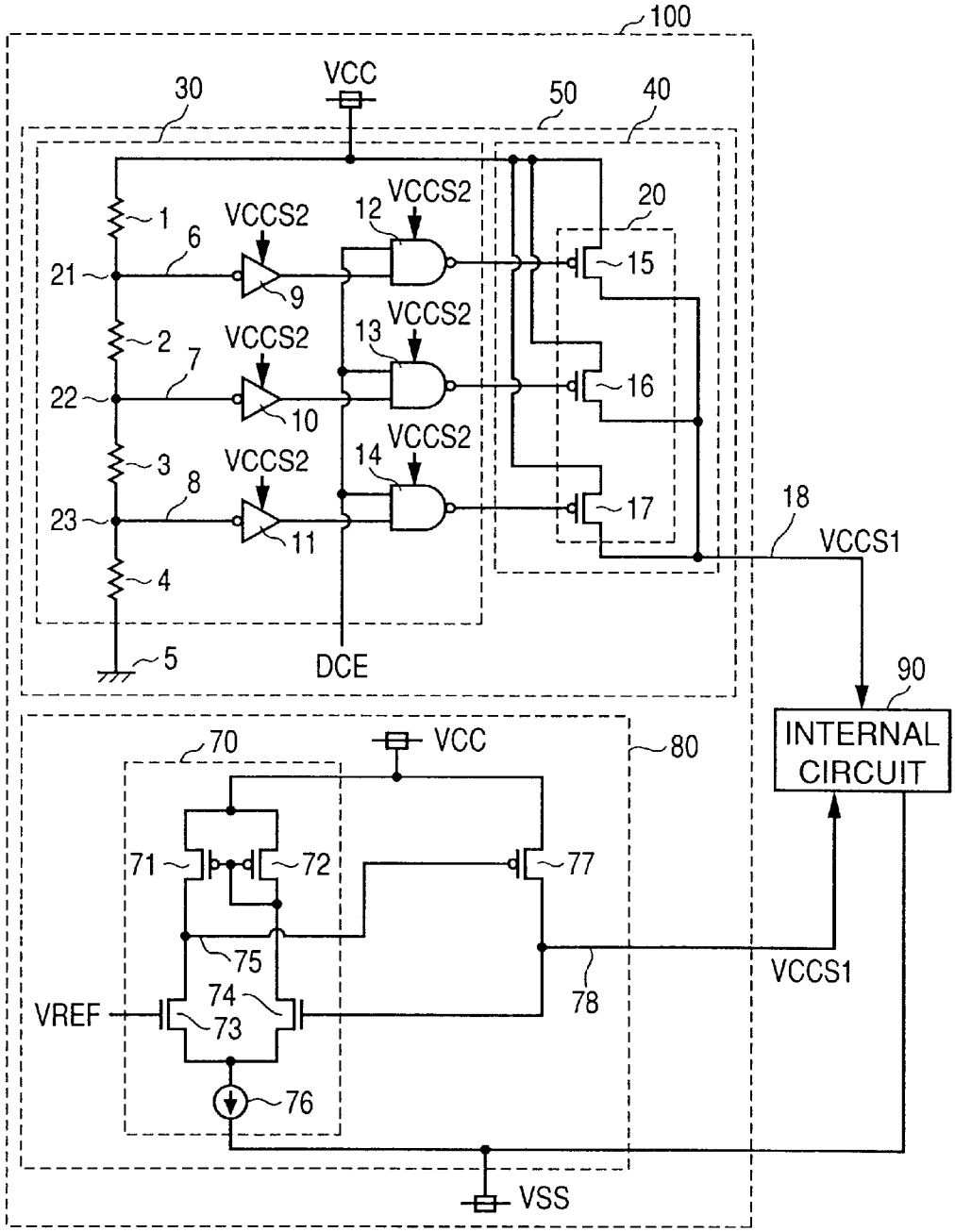
FIG. 1 is a circuit diagram of a voltage down converter according to the first embodiment.

In the following, the preferred embodiments of the present invention will be described in detail with reference to the drawings. In the drawings, the same or a corresponding portion will be denoted by the same reference character and the description thereof will not be repeated.

First Embodiment

With reference to FIG. 1, a voltage down converter 100 according to the present invention includes a voltage down converting circuit 50 and a voltage down converting circuit 80. Voltage down converting circuit 50 includes a digital driving circuit 30 and a voltage down converting circuit 40. Digital driving circuit 30 includes resistance elements 1~4, nodes 6~8, inverters 9~11 and NAND's 12~14. Voltage down converting circuit 40 is constituted of P channel MOS transistors 15~17. Here, P channel MOS transistors 15~17 have the same channel width.

Figure 2:
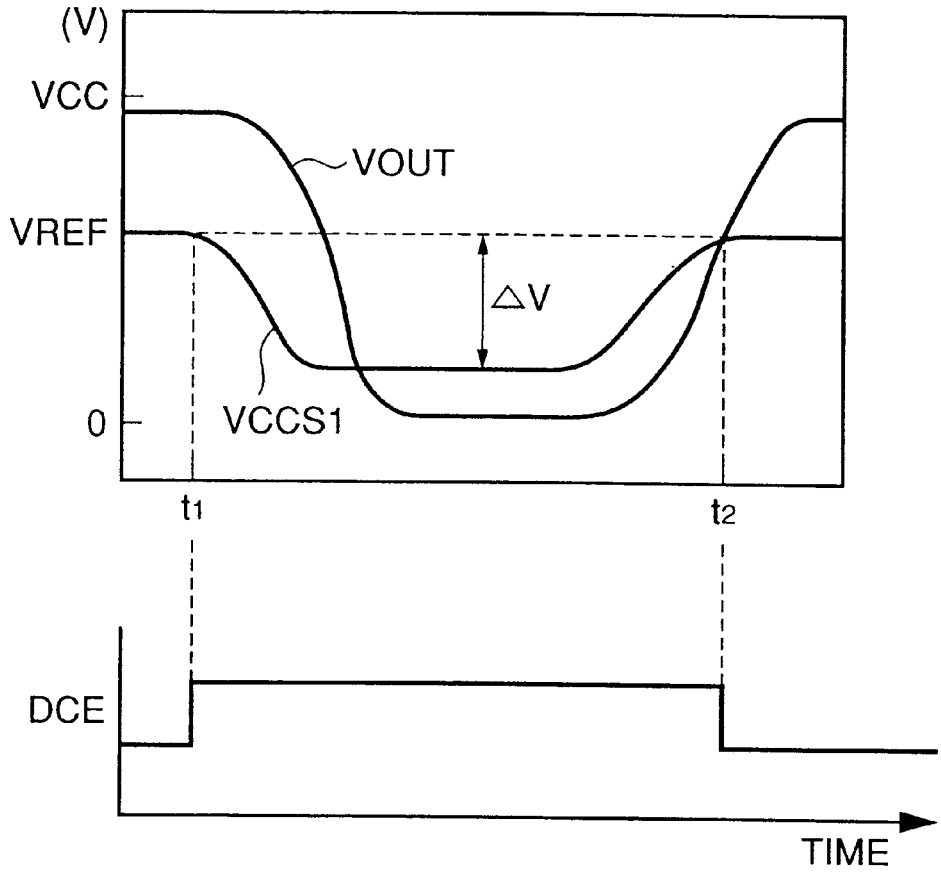
FIG. 2 is a timing chart showing a control voltage and an internal power supply voltage in a conventional voltage down converting circuit and an operation timing of a voltage down converting, circuit of FIG. 1.

Resistance elements 1~4 are connected in series between a VCC power supply node and a ground terminal 5. Node 6 has one end connected to a connection point 21 between resistance element 1 and resistance element 2. Node 7 has one end connected to a connection point 22 between resistance element 2 and resistance element 3. Node 8 has one end connected to a connection point 23 between resistance element 3 and resistance element 4. Inverter 9 is connected at another end of node 6. Inverter 10 is connected at another end of node 7. Inverter 11 is connected at another end of node 8. NAND 12 has one input terminal receiving an output signal of inverter 9 and another input terminal receiving a signal DCE. NAND 13 has one input terminal receiving an output signal of inverter 10 and another input terminal receiving signal DCE. NAND 14 has one input terminal receiving an output signal of inverter 11 and another input terminal receiving signal DCE. Signal DCE attains an H level only during a period in which internal circuit 90 operates and lowers an internal power supply voltage VCCS1 by a large amount as shown in FIG. 2.

Resistance elements 1~4 divide external power supply voltage VCC. Resistance element 1 has a resistance of 1.2 kΩ, resistance element 2 has resistance of 0.2 kΩ, resistance element 3 has resistance of 0.08 kΩ and resistance element 4 has resistance of 1.12 kΩ. Then, when external power supply voltage VCC of standard voltage 2.5 V varies in the range of 2.2~2.8 V, a voltage V21 at connection point 21, a voltage V22 at connection point 22 and a voltage V23 at connection point 23 attain values as shown in Table 1. In brief, when external power supply voltage VCC exceeds standard value 2.5 V, the levels of voltage V21, V22, V23 also rise, whereas when external power supply voltage VCC falls below standard value 2.5 V, the levels of voltage V21, V22, V23 also fall.

2.2~2.7 V and outputs an output signal of an H level when external power supply voltage VCC is 2.8 V.

NAND 12 outputs an output signal to a gate terminal of P channel MOS transistor 15 in voltage down converting circuit 40 to activate/inactivate P channel MOS transistor 15. NAND 13 outputs an output signal to a gate terminal of P channel MOS transistor 16 in voltage down converting circuit 40 to activate/inactivate P channel MOS transistor 16. NAND 14 outputs an output signal to a gate terminal of P channel MOS transistor 17 in voltage down converting circuit 40 to active/inactivate P channel MOS transistor 17.

Then, when the relation 2.2 V≦external power supply voltage VCC <2.4 V holds, three P channel MOS transistors 15~17 included in voltage down converting circuit 40 are all activated. Further, when the relation 2.4 V≦external power supply voltage VCC<2.6 V holds, two P channel MOS transistors 16 and 17 in voltage down converting circuit 40 are activated and P channel MOS transistor 15 is inactivated. Still further, when the relation 2.6 V≦external power supply voltage VCC≦2.8 V holds, only P channel MOS transistor

TABLE 1

| $V_{CC}$ (V) | $V_{21}$ (V) | $V_{22}$ (V) | $V_{23}$ (V) | IN-VERTER 9 | IN-VERTER 10 | IN-VERTER 11 | NAND 12 | NAND 13 | NAND 14 | MOS 15 | MOS 16 | MOS 17 |
|---|---|---|---|---|---|---|---|---|---|---|---|---|
| 2.2 | 1.14 | 1.06 | 0.99 | H | H | H | L | L | L | ACTIVE | ACTIVE | ACTIVE |
| 2.3 | 1.20 | 1.10 | 1.03 | H | H | H | L | L | L | ACTIVE | ACTIVE | ACTIVE |
| 2.4 | 1.25 | 1.15 | 1.08 | L | H | H | H | L | L | INACTIVE | ACTIVE | ACTIVE |
| 2.5 | 1.30 | 1.20 | 1.12 | L | H | H | H | L | L | INACTIVE | ACTIVE | ACTIVE |
| 2.6 | 1.35 | 1.25 | 1.16 | L | L | H | H | H | L | INACTIVE | INACTIVE | ACTIVE |
| 2.7 | 1.40 | 1.30 | 1.21 | L | L | H | H | H | L | INACTIVE | INACTIVE | ACTIVE |
| 2.8 | 1.46 | 1.34 | 1.25 | L | L | L | H | H | H | INACTIVE | INACTIVE | INACTIVE |

All inverters 9~11 have threshold value of 1.25 V. Inverters 9~11compare voltages on nodes 6~8 with the threshold value, resp when the voltages on nodes 6~8 are higher than the threshold value, inverters output output signals of an L level and when the voltages on nodes 6~8 are lower than the threshold value, inverters output output signals of an H level. Then, when external power supply voltage VCC varies in the range of 2.2~2.8 V, inverters 9~11 output output signals as shown in Table 1. When external power supply voltage VCC is in the range of 2.2~2.3 V, inverter 9 outputs an output signal of an H level, and when external power supply voltage VCC is in the range of 2.4~2.8 V, inverter 9 outputs an output signal of an L level. Inverter 10 outputs an output signal of an H level when external power supply voltage VCC is in the range of 2.2~2.5 V and outputs an output signal of an L level when external power supply voltage VCC is in the range of 2.6~2.8 V. Inverter 11 outputs an output signal of an H level when external power supply voltage VCC is in the range of 2.2~2.7 V and outputs an output signal of an L level when external power supply voltage VCC is 2.8 V.

Then, in a period when signal DCE is at an H level, NAND's 12~14 output signals as shown in Table 1. In brief, NAND 12 outputs an output signal of an L level when external power supply voltage VCC is in the range of 2.2~2.3 V and outputs an output signal of an H level when external power supply voltage VCC is in the range of 2.4~2.8 V. NAND 13 outputs an output signal of an L level when external power supply voltage VCC is in the range of 2.2~2.5 V and outputs an output signal of an H level when external power supply voltage VCC is in the range of 2.6~2.8 V. NAND 14 outputs an output signal of an L level when external power supply voltage VCC is in the range of

17 in voltage down converting circuit 40 is activated and P channel MOS transistors 15 and 16 are inactivated.

In brief, when external power supply voltage VCC is at a level of the reference voltage, satisfying the relation 2.4 V≦external power supply voltage VCC<2.6 V, two P channel MOS transistors 16 and 17 are activated; when external power supply voltage VCC falls below the reference voltage to satisfy the relation 2.2 V≦external power supply voltage VCC<2.4 V, all of three P channel MOS transistors 15~17 are activated; and when external power supply voltage VCC becomes higher than the reference voltage, satisfying the relation 2.6 V≦external power supply voltage VCC≦2.8 V, one P channel MOS transistor 17 is activated.

Thus, the number of P channel MOS transistors to be activated among parallel connected three P channel MOS transistors 15~17 can be changed according to the level of external power supply voltage VCC. As a result, a current value supplied from the VCC power supply node to power supply node 18 changes. Here, P channel MOS transistors 15~17 have the same channel width. Hence, if [I] represents the current value flowing through one P channel MOS transistor when activated, if one P channel MOS transistor is activated, a current having a current value of [I] is supplied to power supply node 18; when two P channel MOS transistors are activated, a current with a current value of 2 [I] is supplied to power supply node 18; and when three P channel MOS transistors are activated, a current with a current value of 3 [I] is supplied to power supply node 18.

Thus, digital driving circuit 40 activates two P channel MOS transistors 16 and 17 to pass the reference current for generating internal power supply voltage VCCS1 of 2.0 V on power supply node 18 when external power supply voltage VCC is at the level of reference value; activates P channel MOS transistor 17 alone to reduce the current value supplied to power supply node 18 below the reference current value when external power supply voltage VCC becomes higher than the reference value; and activates three P channel MOS transistors 15~17 to increase the current value supplied to power supply node 18 above the reference current value when external power supply voltage VCC falls below the reference value. Thus, voltage down converting circuit 40 lowers external power supply voltage VCC to generate internal power supply voltage VCCS1 on power supply node 18. In addition, voltage down converting circuit 40 can maintain the voltage level on power supply node 18 at the level of internal power supply voltage VCCS1 of 2.0 V regardless of the variation in external power supply voltage VCC.

Voltage down converting circuit 50 supplies internal power supply voltage VCCS1 generated on power supply node 18 to internal circuit 90. When signal DCE is at an L level, P channel MOS transistors 15~17 are all inactivated because NAND 12~14 output a signal of an H level regardless of the level of the output signal from inverters 9~11. In brief, signal DCE is a signal to drive voltage down converting circuit 50 only during a period when internal power supply voltage VCCS1 falls by a significant amount.

P channel MOS transistors 15~17 constituting voltage down converting circuit 40 can be regarded as one P channel MOS transistor 20 with a variable channel width. The channel width of P channel MOS transistor 20 can be changed based on output signals from NAND 12~14, to a channel width W1 for passing a current with a current value of [I], a channel width W2 passing a current with a current value 2 [I], and a channel width W3 passing a current with a current value of 3 [I]. In other words, P channel MOS transistor 20 sets the channel width to W2 when external power supply voltage VCC is at a level of the reference voltage satisfying the relation 2.4 V≦external power supply voltage VCC<2.6 V, and to W3 when external power supply voltage VCC falls below a level of the reference voltage satisfying the relation 2.2 V≦external power supply voltage VCC<2.4 V, and sets to W1 when the external power supply voltage VCC becomes higher than a level of the reference voltage, satisfying the relation 2.6 V≦external power supply voltage VCC≦2.8 V. Thus, voltage down converting circuit 40 lowers external power supply voltage VCC to generate an internal power supply voltage VCCS1 on power supply node 18. In addition, voltage down converting circuit 40 can maintain the voltage level on power supply node 18 at a level of internal power supply voltage VCCS1 of 2.0 V regardless of the variation in external power supply voltage VCC.

In voltage down converting circuit 50, it is necessary to prevent the current value supplied from VCC power supply node to a power supply node 18 from being changed through the variation in external power supply voltage VCC, when external power supply voltage VCC varies in the range of 2.2~2.8 V centering the reference value of 2.5 V. Hence, the number of P channel MOS transistors 15~17 to be activated is changed according to the level of external power supply voltage VCC. It is a voltage divider circuit constituted of series connected resistance elements 1~4 that allows the selective activation of three P channel MOS transistors 15~17 based on the level of external power supply voltage VCC. Hence, resistance values of respective resistance elements 1~4 must be set to appropriate resistance values for dividing the external power supply voltage VCC such that the number of P channel MOS transistors to be activated among three P channel MOS transistors 15~17 can be changed stepwise from two to tree and to one when external power supply voltage VCC changes to the level of the reference voltage, 2.5 V, the level, 2.2~2.4 V, lower than the reference voltage and to the level, 2.6~2.8 V, higher than the reference voltage, respectively.

Therefore, in the present invention, the channel width of respective P channel MOS transistors 15~17 are so determined that the same operating current flows when external power supply voltage VCC is at the level of 2.2 V, 2.5 V or 2.8 V in a range where a source-drain current of P channel MOS transistors 15~17 is proportional to a source-drain voltage, when P channel MOS transistors 15~17 are activated. Then, based on the determined channel width, resistance values of resistance elements 1~4 are so determined that two, three, and one P channel MOS transistors are activated when external power supply voltage VCC attains the level of reference voltage 2.5 V, a level, 2.2~2.4 V, lower than the reference voltage and a level, 2.6~2.8 V, higher than the reference voltage, respectively. Here, the channel width of P channel MOS transistors 15~17 determined in this manner are the same.

Figure 8:
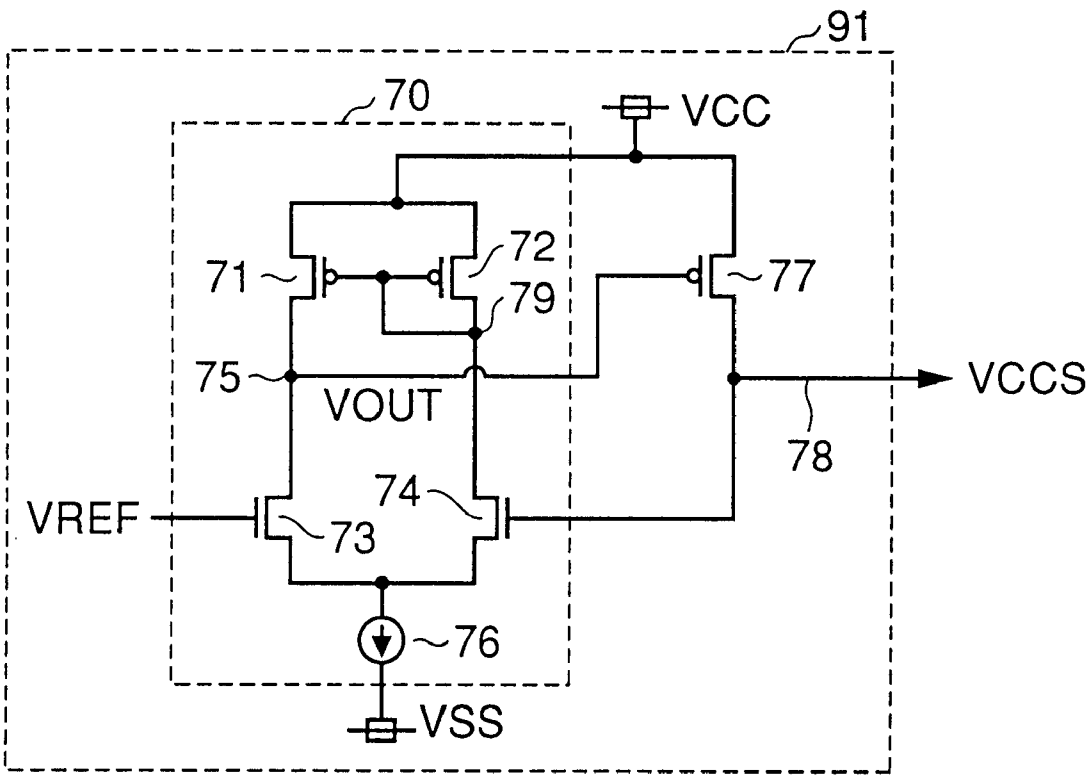
FIG. 8 PRIOR ART
FIG. 8 is a circuit diagram of a conventional voltage down converter.
Figure 9:
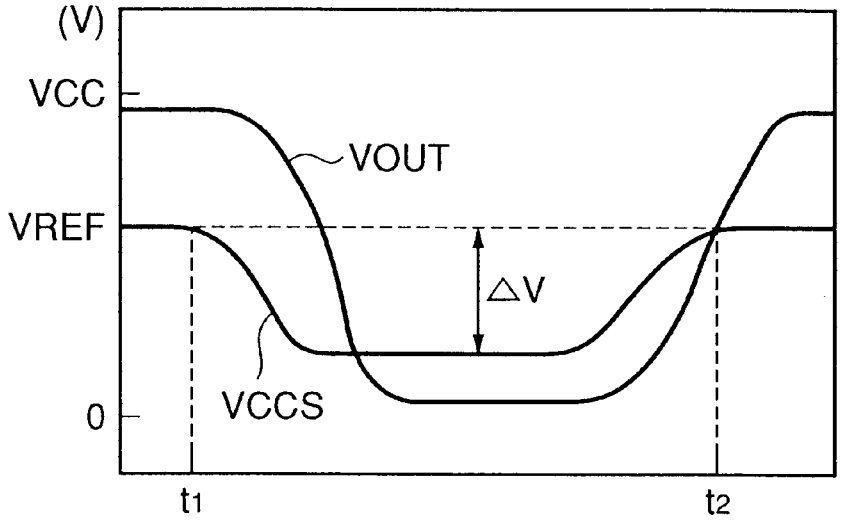
FIG. 9 PRIOR ART
FIG. 9 is a timing chart showing a control voltage and an internal power supply voltage in a conventional voltage down converting circuit.
Figure 10:
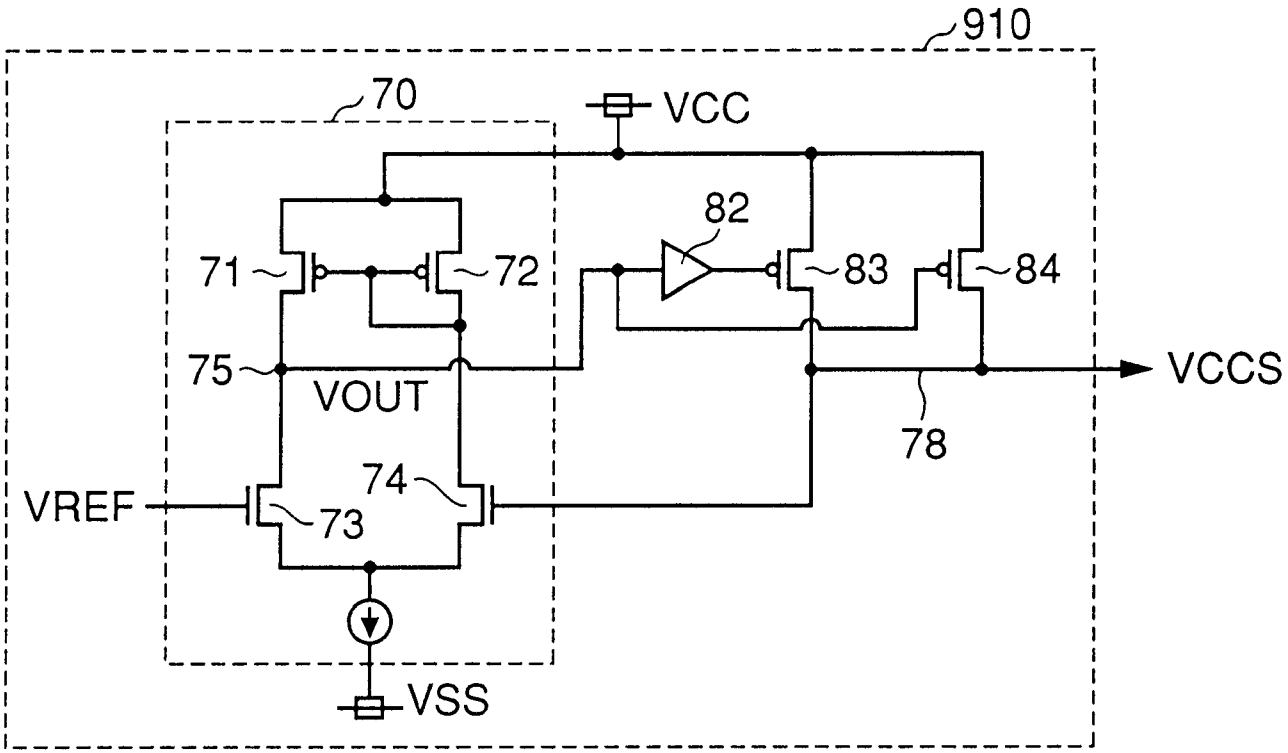
FIG. 10 PRIOR ART
FIG. 10 is another circuit diagram of a conventional voltage down converter.

Voltage down converting circuit 80 has the same structure as voltage down converter 91 shown in FIG. 8. Voltage down converting circuit 80 supplies internal power supply voltage VCCS1 generated on power supply node 78 to internal circuit 90. Voltage down converter 100 drives voltage down converting circuit 50 when signal DCE is at an H level and supplies internal power supply voltage VCCS1 to internal circuit 90 via voltage down converting circuit 50 and voltage down converting circuit 80. When signal DCE is at an L level, voltage down converter 100 does not drive voltage down converting circuit 50 and supplies internal power supply voltage VCCS1 to internal circuit 90 only via voltage down converting circuit 80. As shown in FIG. 2, signal DCE attains an H level and drives voltage down converting circuit 50 only during a period when internal power supply voltage VCCS1 supplied by voltage down converting circuit 80 falls by a significant amount. Hence, voltage down converter 100 can always supply a stable internal power supply voltage VCCS1 to internal circuit 90. Internal circuit 90 includes a sense amplifier to amplify a potential difference between bit lines forming a pair read out from the memory cell, which potential difference indicates data, and when the potential difference of the bit line pair is amplified by the sense amplifier, internal power supply voltage VCCS1 falls by a significant amount. Hence, typical signal DCE is a signal attaining an H level only during a period when the potential difference of the bit line pair is amplified through the sense amplifier. The period in which signal DCE attains an H level can be predetermined because the amplification by the sense amplifier is performed in synchronization with a row address strobe signal/RAS. Therefore, signal DCE can readily be generated.

Figure 3:
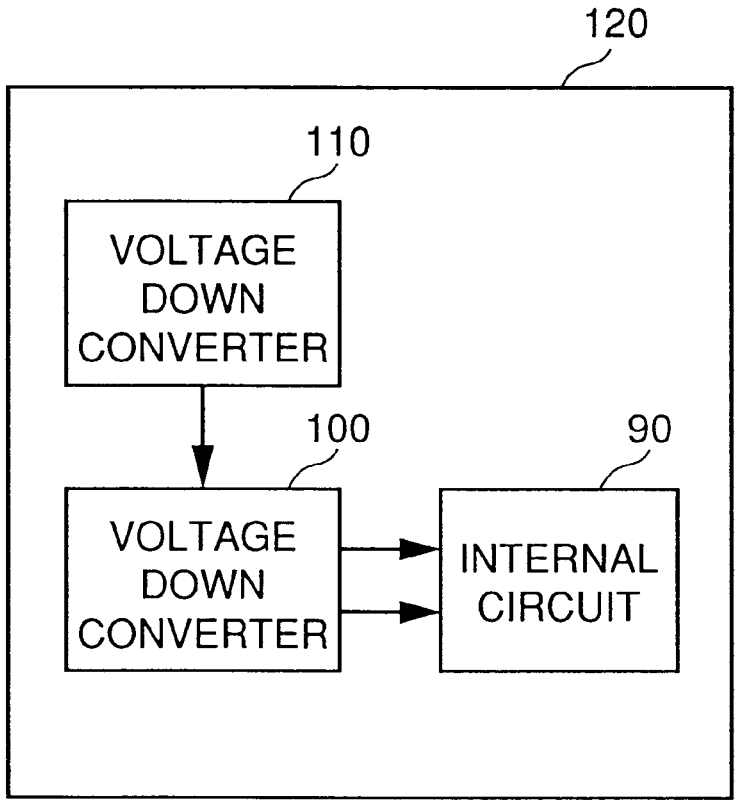
FIG. 3 is a schematic block diagram of semiconductor memory device including a voltage down converter shown in FIG. 1.

Here, inverters 9~11 and NAND's 12~14 of voltage down converting circuit 50 forming voltage down converter 100 operate with an internal power supply voltage VCCS2 at a different level from that of internal power supply voltage VCCS1. Hence, a semiconductor memory device 120 employing voltage down converter 100 includes internal circuit 90, and voltage down converters 100 and 110 as shown in FIG. 3. Voltage down converter 110 is of the same structure as voltage down converting circuit 91 shown in FIG. 8 and lowers external power supply voltage VCC to generate internal power supply voltage VCCS2. Then, voltage down converter 110 supplies the generated internal power supply voltage VCCS2 as an operating power supply to inverters 9~11 and NAND's 12~14 of voltage down converting circuit 50 included in voltage down converter 100.

Figure 4:
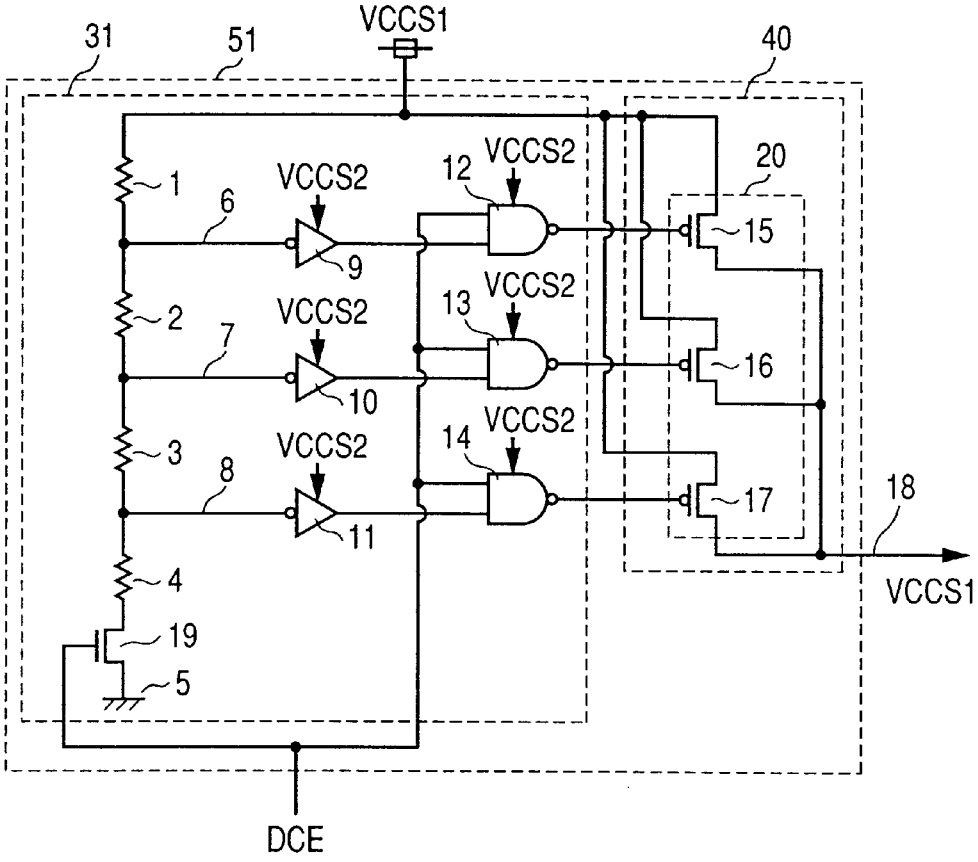
FIG. 4 is a circuit diagram of another voltage down converting circuit employed in a voltage down converter of FIG. 1.

As described above, voltage down converting circuit 50 of voltage down converter 100 is not driven when signal DCE attains an L level. Hence, while signal DCE is at an L level, a through current flows through resistance elements 1~4 via ground terminal 5. Then, current is consumed in voltage down converting circuit 50 which is not driven. Hence, to implement a low power consumption semiconductor memory device, a voltage down converter including a voltage down converting circuit 51 instead of voltage down converting circuit 50 as shown in FIG. 4 preferably is employed in the present invention. Voltage down converting circuit 51 includes a digital driving circuit 31 instead of digital driving circuit 30 of voltage down converting circuit 50. Digital driving circuit 31 includes an N channel MOS transistor 19 between resistance element 4 and ground terminal 5 of digital driving circuit 30. Here, N channel MOS transistor 19 is activated only when signal DCE attains an H level. Hence a through current flows to resistance elements 1~4 via ground terminal 5 in voltage down converting circuit 51 only when signal DCE drives voltage down converting circuit 51. Thus the reduction in current consumption can be achieved.

According to the first embodiment, voltage down converter 100 does not compare the level of internal power supply voltage VCCS1 with the level of reference voltage VREF and instead employs voltage down converting circuits 50 and 51 to maintain the voltage level at power supply node 18 at the level of internal power supply voltage VCCS1 by changing the number of P channel MOS transistors to be activated among P channel MOS transistors 15~17 according to the level of external power supply voltage VCC. Hence, even when the internal power supply voltage VCCS1 falls by a significant amount, stable internal power supply voltage VCCS1 can be supplied.

Second Embodiment

Figure 5:
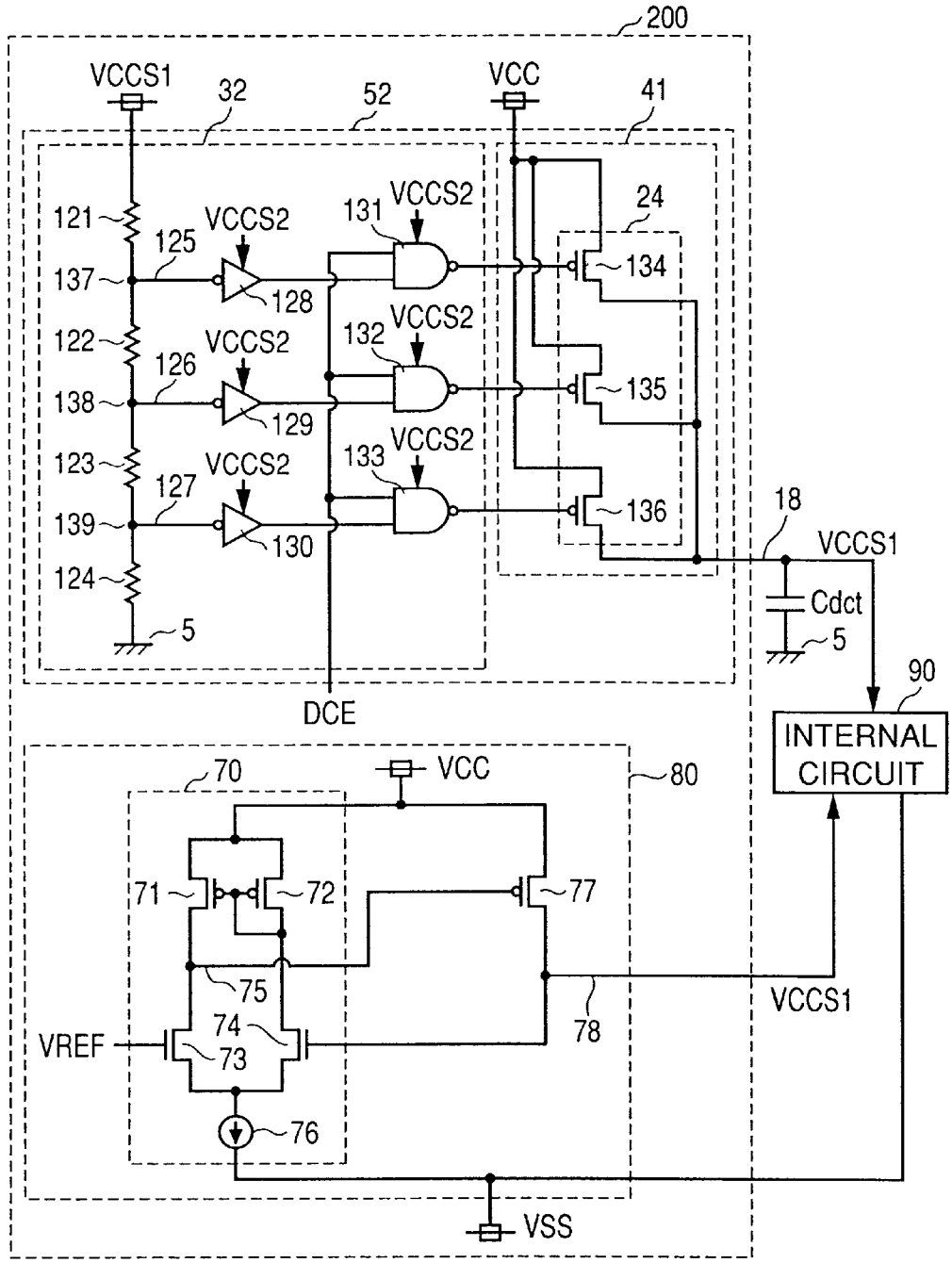
FIG. 5 is a circuit diagram of a voltage down converter according to the second embodiment.

With reference to FIG. 5, a voltage down converter 200 according to the second embodiment of the present invention includes a voltage down converting circuit 52 instead of voltage down converting circuit 50 of voltage down converter 100. Voltage down converting circuit 52 includes a digital driving circuit 32 and voltage down converting circuit 41. Digital driving circuit 32 includes resistance elements 121~124, nodes 125~127, inverters 128~130 and NAND's 131~133. Voltage down converting circuit 41 is constituted from P channel MOS transistors 134~136.

Digital driving circuit 32 includes resistance elements 121~124, nodes 125~127, inverters 128~130 and NAND's 131~133 instead of resistance elements 1~4, nodes 6~8, inverters 9~11 and NAND's 12~14 of digital driving circuit 30 and the manner of connection is same with that of digital driving circuit 30.

In addition, voltage down converting circuit 52 is driven only during a period when signal DCE is at an H level as voltage down converting circuit 50.

Resistance elements 121~124 divides internal power supply voltage VCCS1. Resistance element 121 has a resistance value of 0.53 kΩ, resistance element 122 has a resistance value of 0.08 kΩ, resistance element 123 has a resistance value of 0.07 kΩ and resistance element 124 has a resistance value of 1.32 kΩ. In voltage down converting circuit 52, internal power supply voltage VCCS1 is applied to series connected resistance elements 121~124. Hence, when internal power supply voltage VCCS1 varies in the range of 1.6~2.0 V, a voltage V137 at connection point 137, a voltage V138 at concoction point 138 and a voltage V139 at connection point 139 attain values as shown in Table 2. In brief, when internal power supply voltage VCCS1 becomes higher than standard value 1.9 V, voltages V137, V138 and V139 also rise, and when internal power supply voltage VCCS1 falls below standard value 1.9 V, voltages V137, V138 and V139 also fall.

TABLE 2

| $V_{CCS1}$ (V) | $V_{137}$ (V) | $V_{138}$ (V) | $V_{139}$ (V) | INVERTER 128 | INVERTER 129 | INVERTER 130 | NAND 131 | NAND 132 | NAND 133 | MOS 134 | MOS 135 | MOS 136 |
|---|---|---|---|---|---|---|---|---|---|---|---|---|
| 1.6 | 1.18 | 1.11 | 1.06 | H | H | H | L | L | L | ACTIVE | ACTIVE | ACTIVE |
| 1.7 | 1.25 | 1.18 | 1.12 | L | H | H | H | L | L | INACTIVE | ACTIVE | ACTIVE |
| 1.8 | 1.32 | 1.25 | 1.19 | L | L | H | H | H | L | INACTIVE | INACTIVE | ACTIVE |
| 1.9 | 1.40 | 1.32 | 1.25 | L | L | L | H | H | H | INACTIVE | INACTIVE | INACTIVE |
| 2.0 | 1.47 | 1.39 | 1.32 | L | L | L | H | H | H | INACTIVE | INACTIVE | INACTIVE |

All inverters 128~130 have a threshold value of 1.25 V. Inverters 128~130 compare voltages on nodes 125~127 with the threshold value, respectively, and when the voltages on nodes 125~127 are higher than the threshold value, inverters 128~130 output output signals at an L level and when voltages on nodes 125~127 are lower than the threshold value, inverters 128~130 output output signals of an H level. Thus, when internal power supply voltage VCCS1 varies in the range of 1.6~2.0 V, inverters 128~130 output output signals as shown in Table 2. In brief, when internal power supply voltage VCCS1 is in the range of 1.6~1.7 V, inverter 128 outputs an output signal of an H level and when internal power supply voltage VCCS1 is in the range of 1.7~2.0 V, inverter 128 outputs an output signal of an L level. Inverter 129 outputs an output signal of an H level when internal power supply voltage VCCS1 is in the range of 1.6~1.8 V and outputs an output signal of an L level when internal power supply voltage VCCS1 is in the range of 1.8~2.0 V. Inverter 130 outputs an output signal of an H level when internal power supply voltage VCCS1 is in the range of 1.6~1.9 V and outputs an output signal of an L level when internal power supply voltage VCCS1 is in the range of 1.9~2.0 V.

Then, NAND's 131~133 output output signals as shown in Table 2 during a period when signal DCE attains an H level. In brief, NAND 131 outputs an output signal of an L level when internal power supply voltage VCCS1 is at a level satisfying the relation 1.6≦VCCS1<1.7 V and outputs an output signal of an H level when internal power supply voltage VCCS1 is at a level satisfying the relation 1.7≦VCCS1≦2.0 V. NAND 132 outputs an output signal of an L level when internal power supply voltage VCCS1 is at a level satisfying the relation 1.6≦VCCS1<1.8 V and outputs an output signal of an H level when internal power supply voltage VCCS1 is at a level satisfying the relation 1.8≦VCCS1≦2.0 V. NAND 133 outputs an output signal of an L level when internal power supply voltage VCCS1 is at a level satisfying the relation 1.6≦VCCS1<1.9 V and outputs an output signal of an H level when internal power supply voltage VCCS1 is at a level satisfying the relation 1.9≦VCCS1≦2.0 V.

A process to activate/inactivate P channel MOS transistors 134~136 via NAND's 131~133 is same with the process to activate/inactivate P channel MOS transistors 15~17 via NAND's 12~14.

Thus, the number of P channel MOS transistors to be activated among parallel connected three P channel MOS transistors 134~136 can be changed according to the level of internal power supply voltage VCC. When internal power supply voltage VCCS1 is at a level satisfying the relation 1.6≦VCCS1<1.7 V, P channel MOS transistors 134~136 are activated. When internal power supply voltage VCCS1 is at a level satisfying the relation 1.7≦VCCS1<1.8 V, P channel MOS transistors 135 and 136 are activated. When internal power supply voltage VCCS1 is at a level satisfying the relation 1.8≦VCCS1<1.9 V, only P channel MOS transistor 136 is activated. When internal power supply voltage VCCS1 is at a level satisfying the relation 1.9≦VCCS1≦2.0 V, P channel MOS transistors 134~136 are activated.

Voltage down converting circuit 52 generates internal power supply voltage VCCS1 in the range 1.8~2.0 V centering 1.9 V. In voltage down converting circuit 52, when internal power supply voltage VCCS1 on power supply node 18 rises above 1.9 V, P channel MOS transistors 134~136 are inactivated to render a current value flowing from the VCC power supply node to power supply node 18 zero, and to lower a voltage on power supply node 18. Then, when internal power supply voltage VCCS1 on power supply node 18 falls below 1.9 V, P channel MOS transistor 136 is activated and a current is supplied from the VCC power supply node to power supply node 18 and the voltage on power supply node 18 is maintained at the level of 1.9 V. When internal power supply voltage VCCS1 on power supply node 18 falls further below 1.8 V, P channel MOS transistors 134~136 are selectively activated according to a lowered level of internal power supply voltage VCCS1 and a current supplied from the VCC power supply node to power supply node 18 is increased to maintain the voltage on power supply node 18 at 1.9 V.

P channel MOS transistors 134~136 constituting voltage down converting circuit 41 can be regarded as one P channel MOS transistor 24 with a variable channel width. P channel MOS transistor 24 has a channel width which is variable according to a level of internal power supply voltage VCCS1 and the output signals from NAND's 131~133. When internal power supply voltage VCCS1 falls below the reference voltage by a large amount to satisfy the relation 1.6 V≦VCCS1<1.7 V, the channel width of P channel MOS transistor 24 is set to the sum of channel width W134 of P channel MOS transistor 134, channel width W135 of P channel MOS transistor 135 and channel width W136 of P channel MOS transistor 136. Further, when internal power supply voltage VCCS1 falls below the reference voltage to satisfy the relation 1.7 V≦VCCS1<1.8 V, the channel width of P channel MOS transistor 24 is set to the sum of channel width W135 of P channel MOS transistor 135 and channel width W136 of P channel MOS transistor 136. Still further, when internal power supply voltage VCC falls slightly below the reference voltage to satisfy the relation 1.8 V≦VCCS1<1.9 V, the channel width of P channel MOS transistor 24 is set to the same channel width with channel width W136 of P channel MOS transistor 136. Still further, when internal power supply voltage VCCS1 becomes equal to or higher than the reference voltage to satisfy the relation 1.9≦VCCS1, the channel width of P channel MOS transistor 24 is set at zero. Thus, voltage down converting circuit 41 lowers internal power supply voltage VCCS1 to generate internal power supply voltage VCCS1 on power supply node 18. In addition, voltage down converting circuit 41 can maintain a voltage on power supply node 18 at the level of internal power supply voltage VCCS1, 1.9 V, regardless of the variation in internal power supply voltage VCCS1.

In voltage down converting circuit 52, it is necessary to prevent internal power supply voltage VCCS1 from varying according to the variation in the current value supplied from the VCC power supply node to power supply node 18 caused by a variation in external power supply voltage VCC, when external power supply voltage VCC is varied in the range of 2.2~2.8 V centering the reference value of 2.5 V. For this purpose, the number of P channel MOS transistors 134~136 to be activated is changed according to the level of internal power supply voltage VCCS1. Here, it is a voltage divider circuit constituted of series connected resistance elements 121~124 that allows the selective activation of three P channel MOS transistors 134~136 according to the level of internal power supply voltage VCCS1. In other words, the resistance values of resistance elements 121~124 are set at such resistance values for dividing internal power supply voltage VCCS1 that when internal power supply voltage VCCS1 is in the range of 1.6 V≦VCCS1<1.7 V, P channel MOS transistors 134~136 are activated; when internal power supply voltage VCCS1 is in the range of 1.7 V≦VCCS1<1.8 V, P channel MOS transistors 135 and 136 are activated; when internal power supply voltage VCCS1 is in the range of 1.8 V≦VCCS1<1.9 V, P channel MOS transistor 136 is activated; and when internal power supply voltage VCCS1 is in the range of 1.9 V≦VCCS1≦2.0 V, P channel MOS transistors 134~136 are inactivated.

Further, channel width W134 of P channel MOS transistor 134 is determined in the following manner. Let tdet represent a delay time of transmission of the variation of internal power supply voltage VCCS1 in internal circuit 90 to voltage down converting circuit 52. If an initial internal power supply voltage VCCS1 is 1.9 V, in order to prevent internal power supply voltage VCCS1 from exceeding 2.0 V even when the current value supplied from VCC power supply node VCC to power supply node 18 attains zero, the relation I (W134)=0.1 V×Cdec/tdet must be satisfied. Here, Cdec represents a capacitance between power supply node 18 and ground terminal 5. Therefore, channel width W134 of P channel MOS transistor 134 is determined based on the current value between source and drain and delay time tdet at the time when the voltage between source and drain is 2.8 V−2.0 V=0.8 V, in other words, when external power supply voltage VCC is at its upper limit, 2.8 V.

Channel width W135 of P channel MOS transistor 135 is determined based on estimates of source-drain current and the maximum current value at the time when source-drain voltage is 2.2 V−2.0 V=0.2 V, that is, when external power supply voltage VCC is at a lower limit, 2.2 V, such that the operating current flowing from the VCC power supply node to power supply node 18 is at its maximum value.

Channel width W136 of P channel MOS transistor 136 is determined based on the setting of a rising speed of internal power supply voltage VCCS1 at the time of start of operation. When the rising speed of internal power supply voltage VCCS1 at voltage down converting circuit 52 is set to be double the rising speed of the voltage at voltage down converting circuit 80, channel width W136 of P channel MOS transistor 136 is set at the same width with channel width W135 of P channel MOS transistor 135.

Channel width W134, W135 and W136 determined according to the above described manner satisfy the following relation: W is wide when 1.6 V≦VCCS1<1.7 V, W is middle when 1.7 V≦VCCS1<1.8 V and W is narrow when 1.8 V≦VCCS1<1.9 V, where W represents the total channel width of three MOS transistors.

Figure 6:
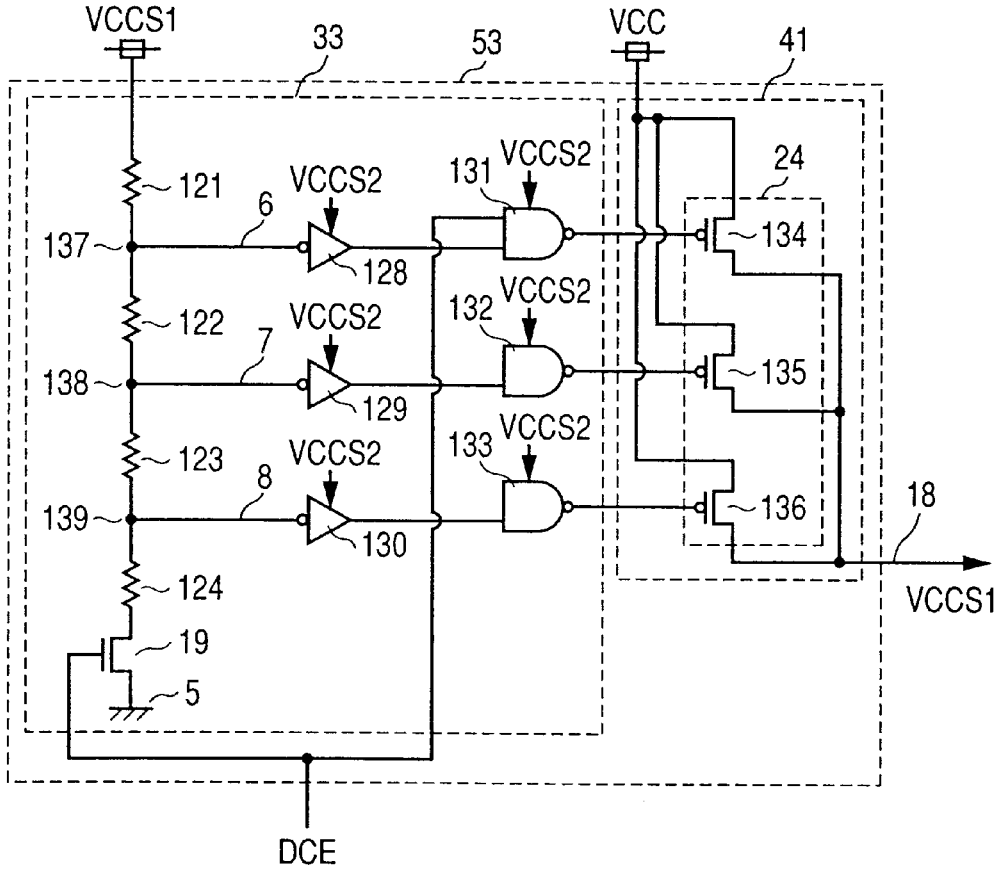
FIG. 6 is a circuit diagram of another voltage down converting circuit employed in a voltage down converter of FIG. 5.
Figure 7:
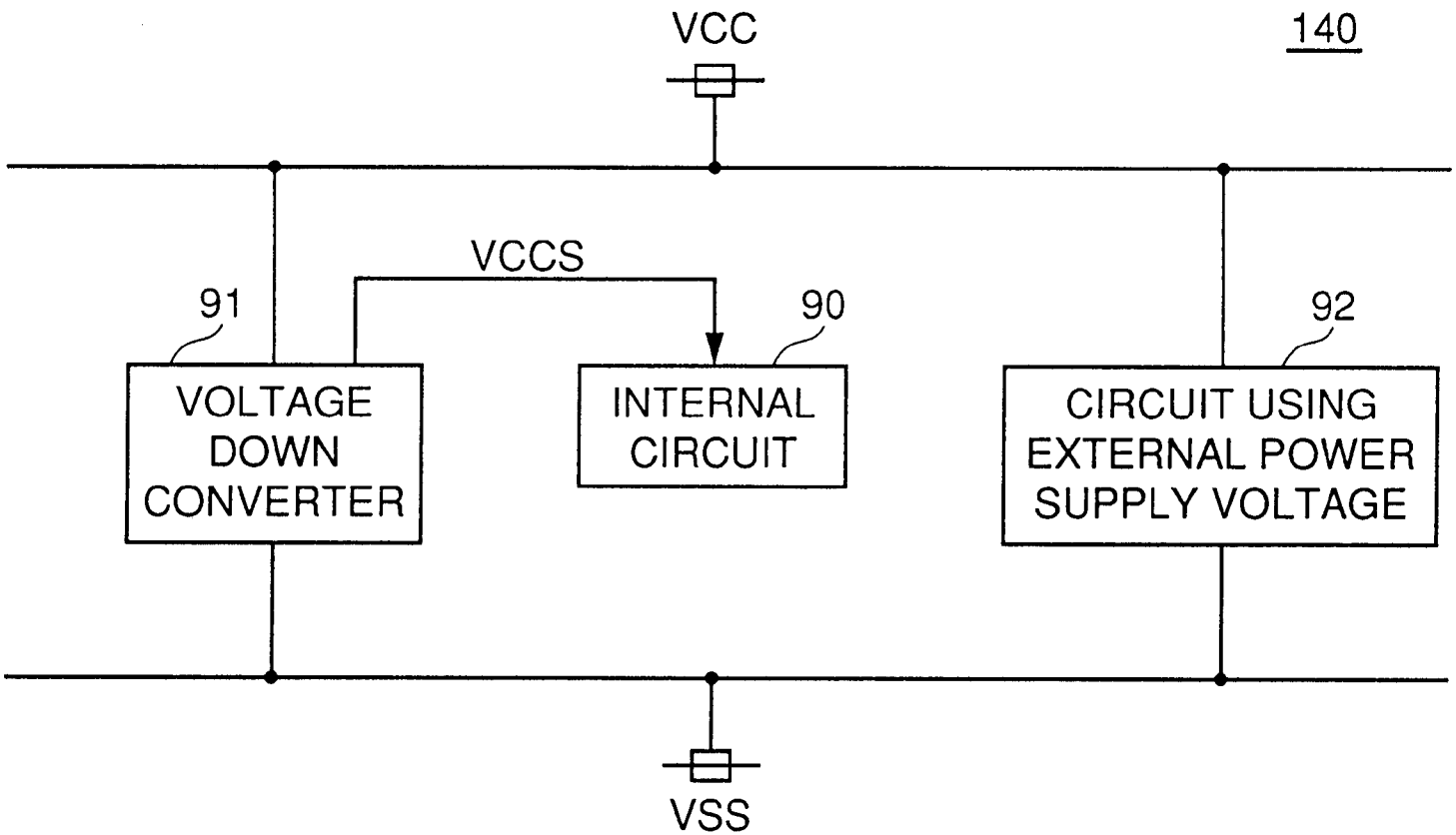
FIG. 7 PRIOR ART
FIG. 7 is a schematic block diagram showing an overall structure of a conventional DRAM.

In voltage down converter 200, a voltage down converting circuit 53 is used instead of voltage down converting circuit 52 as shown in FIG. 6. Voltage down converting circuit 53 employs digital driving circuit 33 instead of digital driving circuit 32 in voltage down converting circuit 52. Digital driving circuit 33 includes N channel MOS transistor 19 between resistance element 124 and ground terminal 5 of digital driving circuit 32. N channel MOS transistor 19 is activated when signal DCE attains an H level. Therefore, in voltage down converting circuit 53, a through current flows through resistance elements 121~124 via ground terminal 5 only during a period when signal DCE drives voltage down converting circuit 53. Thus, the current consumption can be reduced.

According to the second embodiment, a stable internal power supply voltage VCCS1 can be supplied during a period in which internal power supply voltage VCCS1 falls by a large amount, because voltage down converter 200 does not compare internal power supply voltage VCCS1 with reference voltage VREF and adopts voltage down converting circuits 52 and 53 maintaining the voltage on power supply node 18 at internal power supply voltage VCCS1 by changing the number of P channel MOS transistors 134~136 to be activated according to the level of internal power supply voltage VCCS1.

In the present invention, an MOS transistor constituting the voltage down converting circuit is not limited to a P channel MOS transistor and can be an N channel MOS transistor. In this case, AND element is used instead of NAND's 12~14 and 131~133 forming digital driving circuits 30, 31, 32 and 33.

In addition, the number of voltages produced by dividing external power supply voltage VCC or internal power supply voltage VCCS1, and the number of corresponding P channel MOS transistors is not limited to three and can be two, four or more. In other respect, the second embodiment is same with the first embodiment.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A voltage down converter comprising a first voltage down converting circuit to lower an external power supply voltage on a first input node to generate an internal power supply voltage at a first output node, and a second voltage down converting circuit to lower said external power supply voltage on a second input node to generate said internal power supply voltage at a second output node, for operating an internal circuit by said internal power supply voltage generated on said first output node or said second output node, said first voltage down converting circuit including;

a first voltage down converting partial circuit to lower said external power supply voltage by passing an operating current from said first input node to said first output node to generate said internal power supply voltage on said first output node, and a digital driving circuit to drive said first voltage down converting partial circuit to maintain a voltage on said first output node at said internal power supply voltage by varying said operating current stepwise according to a level of said external power supply voltage or said internal power supply voltage only during a period when said internal power supply voltage falls below a predetermined voltage, said second voltage down converting circuit including;

a comparison circuit to perform an operational amplification on a result of comparison of said internal power supply voltage on said second output node and an internal reference voltage to output the result of amplification, and a second voltage down converting partial circuit to receive an output of said comparison circuit and to lower said external power supply voltage to generate said internal power supply voltage on said second output node.

2. The voltage down converter according to claim 1, wherein said first voltage down converting partial circuit is constituted of MOS transistors with variable channel width, said digital driving circuit drives said first voltage down converting partial circuit to change the channel width of said MOS transistor stepwise according to the level of said external power supply voltage or said internal power supply voltage.

3. The voltage down converter according to claim 1, wherein said first voltage down converting partial circuit is constituted of a plurality of MOS transistors having a same channel width and connected in parallel between said first input node and said first output node, said digital driving circuit drives said first voltage down converting partial circuit to change stepwise the number of MOS transistors to be activated among said plurality of MOS transistors according to the level of said external power supply voltage.

4. The voltage down converter according to claim 1, wherein said first voltage down converting partial circuit is constituted of a plurality of MOS transistors connected in parallel between said first input node and said first output node, said digital driving circuit drives said first voltage down converting partial circuit to change stepwise the number of MOS transistors to be activated among said plurality of MOS transistors according to the level of said internal power supply voltage.

5. The voltage down converter according to claim 3, wherein said digital driving circuit includes a voltage divider circuit to divide said external power supply voltage into a plurality of voltages corresponding to said plurality of MOS transistors, and a digital signal generation circuit to generate a digital activation signal based on said plurality of voltages only during a period when said internal power supply voltage falls below a predetermined voltage, and said voltage divider circuit divides said external power supply voltage to generate the digital activation signal to change stepwise the number of MOS transistors to be activated according to the level of said external power supply voltage.

6. The voltage down converter according to claim 4, wherein said digital driving circuit includes a voltage divider circuit to divide said internal power supply voltage into a plurality of voltages corresponding to said plurality of MOS transistors, and a digital signal generation circuit to generate a digital activation signal to selectively activate said plurality of MOS transistors based on said plurality of voltages only during a period when said internal power supply voltage falls below a predetermined voltage, and said voltage divider circuit divides said internal power supply voltage to generate the digital activation signal changing stepwise the number of MOS transistors to be activated according to the level of said internal power supply voltage.

7. The voltage down converter according to claim 5, wherein said voltage divider circuit is constituted of a plurality of resistance elements connected in series between said first input node and the ground terminal, said digital signal generation circuit includes a plurality of nodes provided respectively between plurality of resistance elements to generate said plurality of voltages, a plurality of inverters provided corresponding to said plurality of nodes to convert voltages on said plurality of nodes to an output signal of a first logic or a second logic according to a level of the voltage, and a plurality of logic elements provided corresponding to said plurality of inverters to generate said digital activation signal based on a signal attaining the first logic only during a period when said internal power supply voltage falls below a predetermined voltage and an output signal from each of said plurality of inverters, and each of said plurality of logic elements generates a signal to activate said MOS transistor when said output signal is in the first logic.

8. The voltage down converter according to claim 7, wherein said voltage divider circuit is activated only during a period when said internal power supply voltage falls below a predetermined voltage and said voltage divide circuit further includes an MOS transistor provided between said plurality of resistance elements and said ground terminal.

* * * * *